US010892086B2

(12) United States Patent
Park et al.

(10) Patent No.: US 10,892,086 B2
(45) Date of Patent: Jan. 12, 2021

(54) COIL ELECTRONIC COMPONENT

(71) Applicant: SAMSUNG ELECTRO-MECHANICS CO., LTD., Suwon-si (KR)

(72) Inventors: Kwang Il Park, Suwon-si (KR); Young Sun Kim, Suwon-si (KR); HyeYeon Cha, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 159 days.

(21) Appl. No.: 16/026,351

(22) Filed: Jul. 3, 2018

(65) Prior Publication Data

US 2019/0096564 A1 Mar. 28, 2019

(30) Foreign Application Priority Data

Sep. 26, 2017 (KR) ..... 10-2017-0124288
Oct. 17, 2017 (KR) ..... 10-2017-0134804

(51) Int. Cl.

| | |
|---|---|
| ***H01F 27/28*** | (2006.01) |
| ***H01F 27/32*** | (2006.01) |
| ***H01F 41/04*** | (2006.01) |
| ***H01F 27/29*** | (2006.01) |
| ***H01F 17/00*** | (2006.01) |
| *H01F 17/04* | (2006.01) |

(52) U.S. Cl.

CPC ..... *H01F 27/2804* (2013.01); *H01F 17/0013* (2013.01); *H01F 27/29* (2013.01); *H01F 27/292* (2013.01); *H01F 27/323* (2013.01); *H01F 41/042* (2013.01); *H01F 2017/002* (2013.01); *H01F 2017/048* (2013.01); *H01F 2027/2809* (2013.01)

(58) Field of Classification Search

CPC .... H01F 27/2804; H01F 27/323; H01F 27/29; H01F 27/292; H01F 2027/2809; H01F 17/0013; H01F 17/0006; H01F 2017/048; H01F 2017/002; H01F 2017/0073; H01F 41/042

USPC ..... 336/200, 223, 233, 192

See application file for complete search history.

(56) References Cited

U.S. PATENT DOCUMENTS 10,111,330 B2 * 10/2018 Ueda ..... H05K 1/05
2003/0188886 A1 * 10/2003 Fey ..... H05K 3/243 174/256

(Continued)

FOREIGN PATENT DOCUMENTS

CN 104105334 A 10/2014
CN 105448503 A 3/2016

(Continued)

OTHER PUBLICATIONS

Office Action issued in corresponding Chinese Patent Application No. 201811080048.2 dated Aug. 28, 2020.

*Primary Examiner* — Mang Tin Bik Lian
(74) *Attorney, Agent, or Firm* — Morgan, Lewis & Bockius LLP

(57) ABSTRACT

A coil electronic component includes a coil including upper and lower coils and a via electrically connecting the upper and lower coils to each other. The via is formed along at least a portion of a boundary surface of a through-hole penetrating upper and lower surfaces of a support member supporting the upper and lower coils.

19 Claims, 9 Drawing Sheets

(56) References Cited

U.S. PATENT DOCUMENTS

| | | | | |
|---|---|---|---|---|
| 2008/0268267 | A1* | 10/2008 | Barbetta | H05K 3/244 428/458 |
| 2009/0243781 | A1* | 10/2009 | Nomura | H01F 17/0013 336/200 |
| 2014/0292469 | A1* | 10/2014 | Cha | H01F 17/0013 336/200 |
| 2015/0048918 | A1* | 2/2015 | Park | H01F 17/0013 336/200 |
| 2015/0102891 | A1 | 4/2015 | Yoon et al. | |
| 2015/0340149 | A1* | 11/2015 | Lee | H05K 1/165 174/260 |
| 2016/0078995 | A1* | 3/2016 | Yoon | H01F 17/0013 336/192 |
| 2016/0163444 | A1 | 6/2016 | Choi et al. | |
| 2016/0189840 | A1* | 6/2016 | Ahn | H01F 17/0013 336/192 |
| 2016/0336105 | A1 | 11/2016 | Choi et al. | |

FOREIGN PATENT DOCUMENTS

| | | | | |
|---|---|---|---|---|
| CN | 105742035 | A | | 7/2016 |
| CN | 106158242 | A | | 11/2016 |
| JP | H11-204337 | A | | 7/1999 |
| JP | 2009152347 | A | * | 7/2009 |
| KR | 10-2015-0044372 | A | | 4/2015 |
| KR | 10-2015-0134969 | A | | 12/2015 |

* cited by examiner

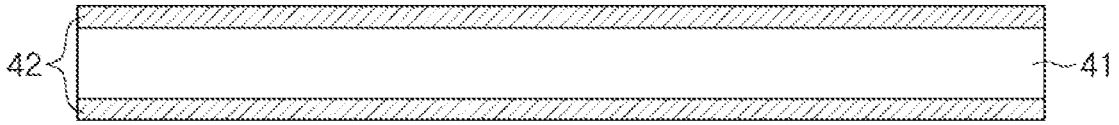
FIG. 4A
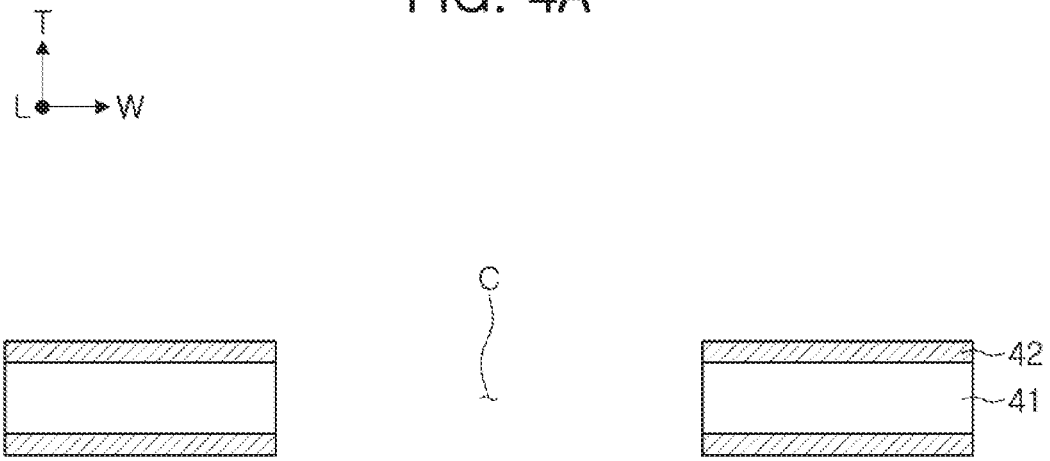
FIG. 4B
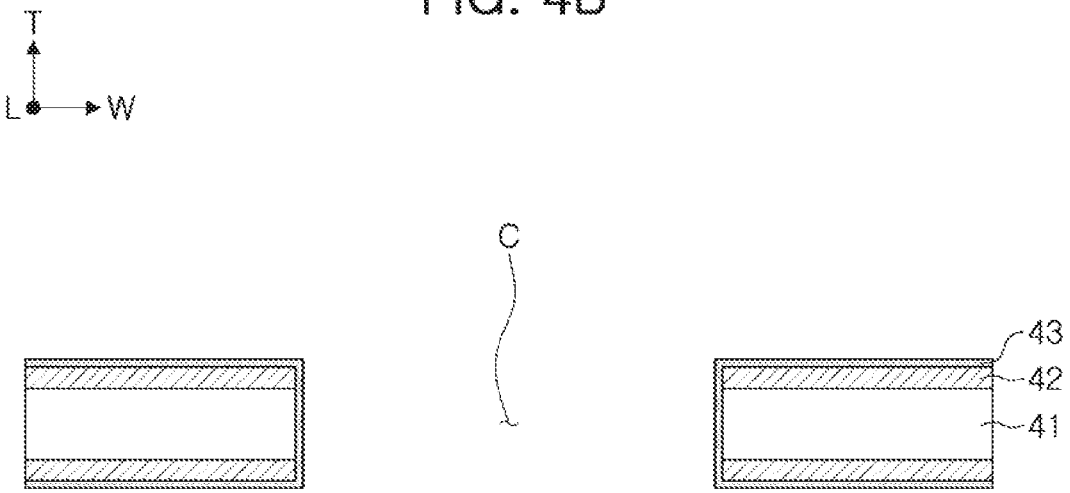
FIG. 4C
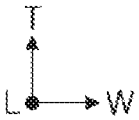

COIL ELECTRONIC COMPONENT

CROSS-REFERENCE TO RELATED APPLICATION(S)

This application claims benefit of priority to Korean Patent Application Nos. 10-2017-0124288 filed on Sep. 26, 2017 and 10-2017-0134804 filed on Oct. 17, 2017 in the Korean Intellectual Property Office, the disclosure of which is incorporated herein by reference in its entirety.

BACKGROUND

1. Field

The present disclosure relates to a coil electronic component, and more particularly, to a thin film type power inductor having high inductance and a small size.

2. Description of Related Art

As electronic products such as smartphones have become smaller with increased performance, there has been a need for miniaturization and performance improvements for electronic components mounted in the electronic products. Therefore, the development of a thin film type power inductor, advantageous in miniaturization, among power inductors, has been demanded.

SUMMARY

An aspect of the present disclosure may provide a coil electronic component in which plating non-uniformity of a plurality of coil patterns is addressed or resolved.

According to an aspect of the present disclosure, a coil electronic component may include a body and external electrodes on external surfaces of the body. The body may include a support member with a through-hole and upper and lower coils on the support member. The upper and lower coils may be connected to each other by a via, and the via may be formed on at least a portion of an edge of the through-hole of the support member.

BRIEF DESCRIPTION OF DRAWINGS

The above and other aspects, features, and advantages of the present disclosure will be more clearly understood from the following detailed description taken in conjunction with the accompanying drawings, in which:

FIGS. 4A through 4H are views illustrating an exemplary process of manufacturing the coil electronic component of FIG. 1;

DETAILED DESCRIPTION

Hereinafter, a coil electronic component according to an exemplary embodiment in the present disclosure will be described, but the present disclosure is not necessarily limited thereto.

Figure 1:
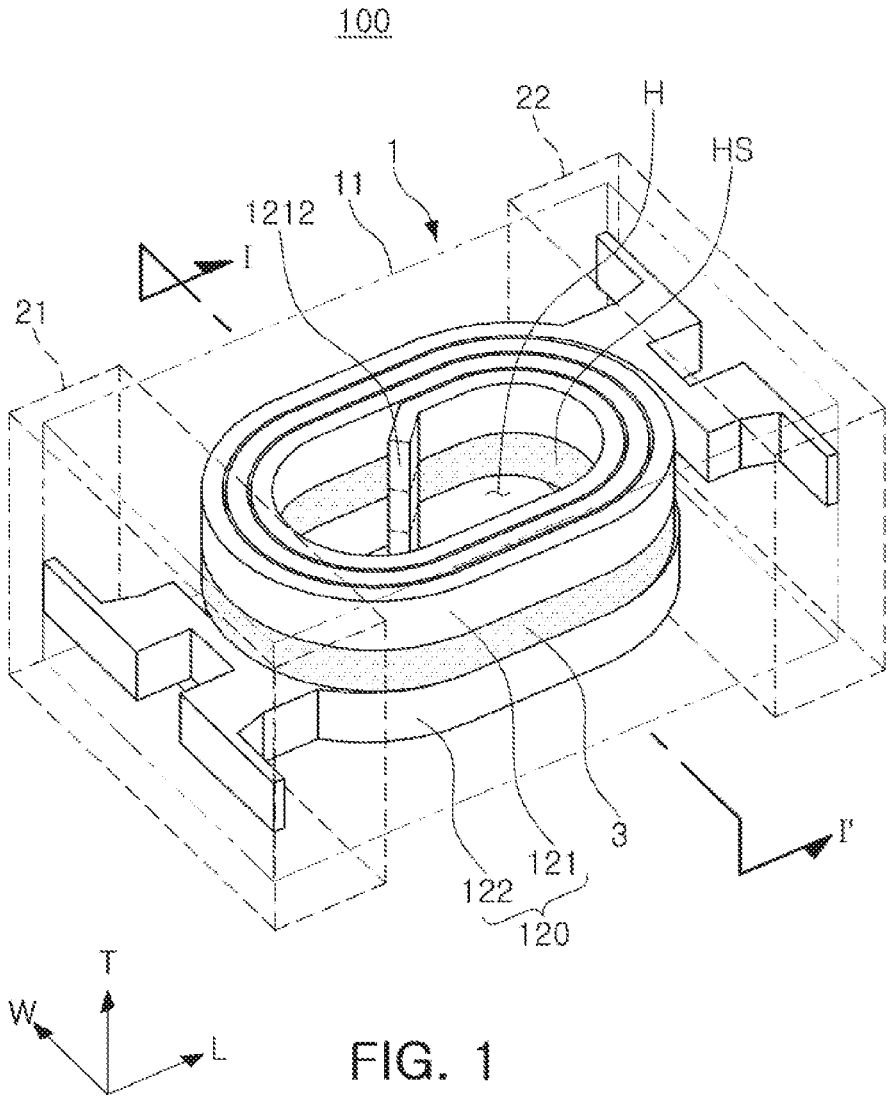
FIG. 1 is a perspective view illustrating a coil electronic component according to an exemplary embodiment in the present disclosure.
Figure 2:
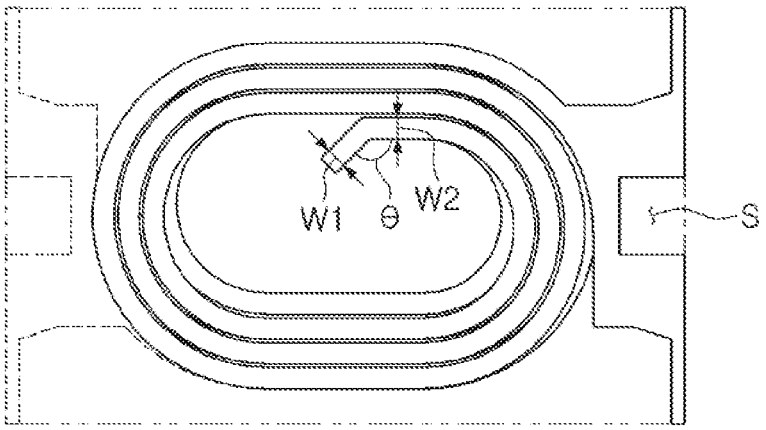
FIG. 2 is a plan view of FIG. 1 when viewed from above.
Figure 3:
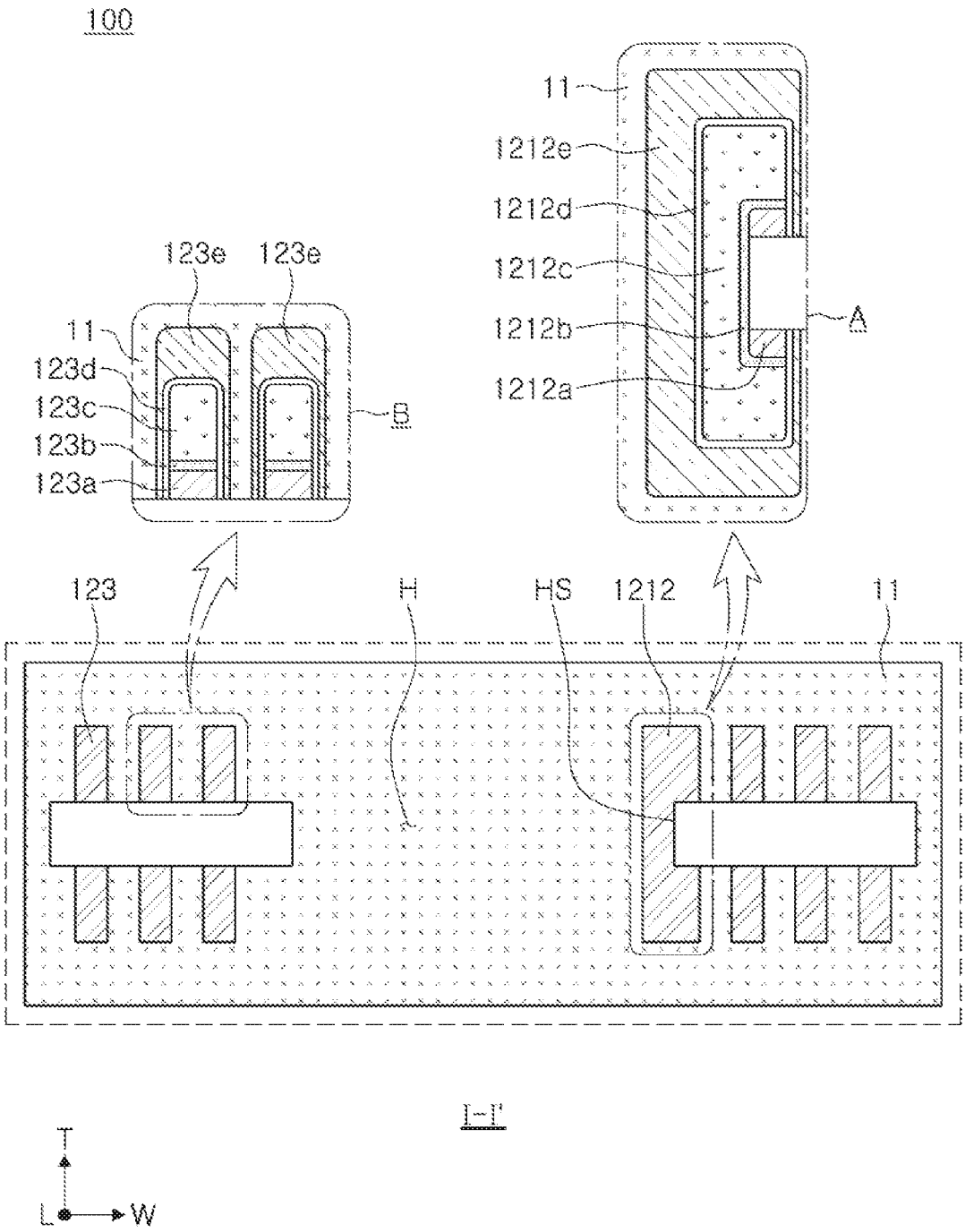
FIG. 3 is a cross-sectional view taken along line I-I' of FIG. 1.

FIG. 1 is a perspective view illustrating a coil electronic component 100 according to an exemplary embodiment in the present disclosure. FIG. 2 is a plan view of an internal coil of FIG. 1 when viewed from above. FIG. 3 is a cross-sectional view taken along line I-I' of FIG. 1.

Referring to FIGS. 1 through 3, the coil electronic component 100 may include a body 1 and external electrodes 21 and 22 disposed on external surfaces of the body.

The body 1 may have an upper surface and a lower surface opposing each other in a thickness direction (T), a first end surface and a second end surface opposing each other in a length direction (L), and a first side surface and a second side surface opposing each other in a width direction (W). Body 1 may thus have a substantially hexahedral shape, but is not limited thereto.

The body 1 may include a magnetic material 11. Here, the magnetic material 11 is not particularly limited as long as it has magnetic properties, and may be, for example, ferrite or a metal base soft magnetic material. The ferrite may include any known ferrite such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy including one or more selected from the group consisting of Fe, Si, Cr, Al, and Ni. For example, the metal based soft magnetic material may include Fe—Si—B—Cr based amorphous metal particles, but is not limited thereto. The metal based soft magnetic material may have a particle diameter of 0.1 μm or more to 20 μm or less, and may be included in a polymer such as an epoxy resin, polyimide, or the like, in a form in which it is dispersed on the polymer.

An internal coil 120 may be encapsulated by the magnetic material 11. The internal coil 120 may include an upper coil 121 and a lower coil 122. The upper coil and the lower coil may be on upper and lower surfaces of a support member 3, respectively.

The support member 3 may be formed of any material that may insulate the upper and lower coils from each other. The insulating material may be a thermosetting resin such as an epoxy resin, a thermoplastic resin such as a polyimide resin, or a resin having a reinforcing material such as a glass fiber or an inorganic filler impregnated in the thermosetting resin and the thermoplastic resin, for example, prepreg, but is not specifically limited thereto.

The support member 3 may have a through-hole "H" penetrating through the upper and lower surfaces thereof. The through-hole may be filled with a magnetic material to make a flow of a magnetic flux smooth and improve magnetic permeability. At least a portion of a boundary surface "HS" of the through-hole may be in contact with a via 1212.

Figure 5A:
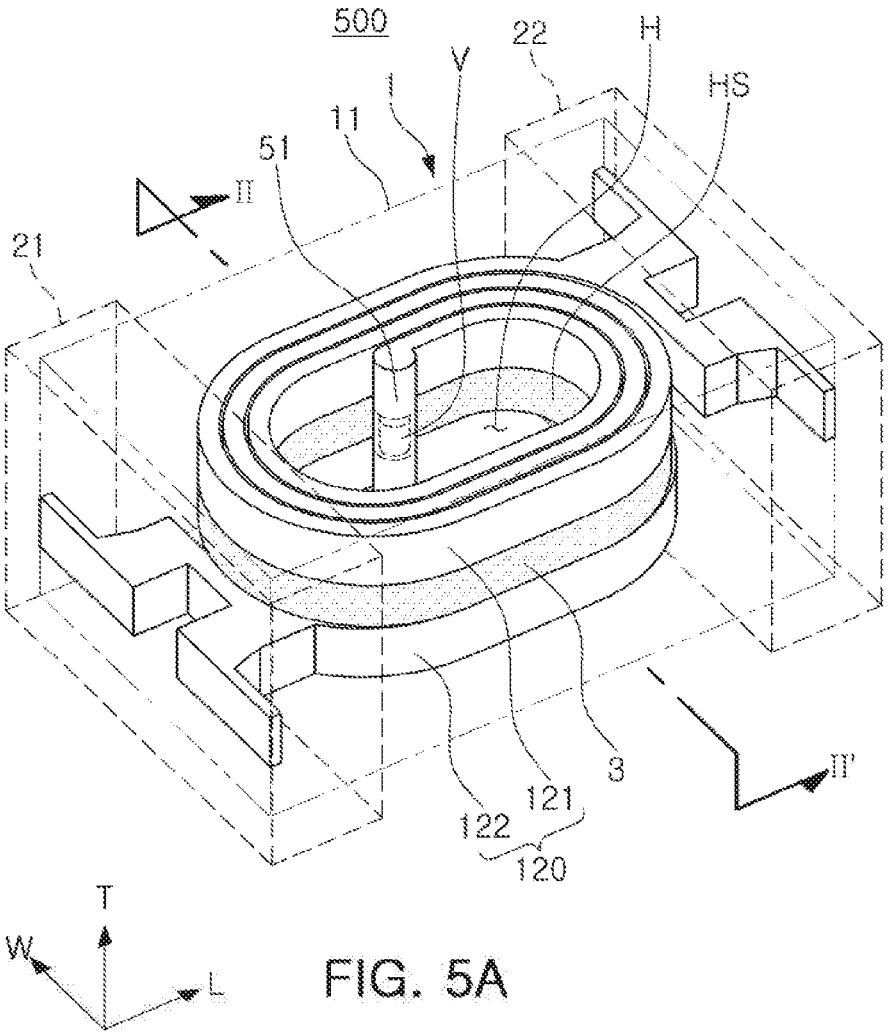
FIG. 5A is a perspective view illustrating a coil electronic component according to the related art.
Figure 5B:
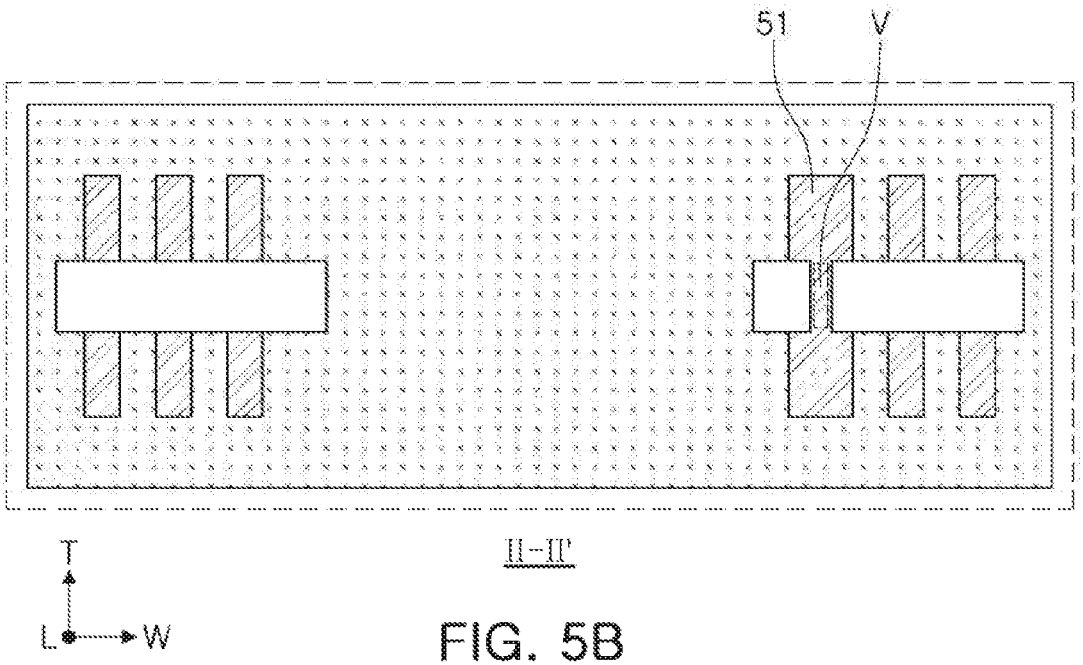
FIG. 5B is a cross-sectional view taken along line II-II' of FIG. 5A.

FIG. 5A is a perspective view illustrating a coil electronic component 500 according to the related art. FIG. 5B is a cross-sectional view taken along line II-II' of FIG. 5A. As illustrated in FIGS. 5A and 5B, in the coil electronic component 500 according to the related art, a via 51 connecting an upper coil and a lower coil to each other may be configured to fill an inner portion of a via hole "V" provided separately from a through-hole of a support member. The via is not formed on a boundary surface of the through-hole of the support member. When the via is formed in a via hole separate from the through-hole, the via pad for forming the via is has a predetermined minimum size to prevent the via from being opened, and the via pad is designed without regard to the line width of the coil pattern connected to the via. When the via pad is formed to have a predetermined minimum size, it is difficult to prevent the line width of the via from being excessively grown as compared to the line width of the coil pattern. As a result, when anisotropic plating is used, a plating deviation between the via and the coil pattern is generated, which can cause non-uniform growth between coil patterns. In addition, since the via hole is formed in addition to the through-hole, the limited size of the support member decreases the free space in which the through-hole may be formed. Having a large through-hole provides advantageous electrical characteristics to the coil electronic component, such as a magnetic permeability, and the like. But the available space is limited, which limits the ability to improve the electrical characteristics of the coil electronic component.

Unlike the coil electronic component 500 according to the related art, the coil electronic component 100 according to the exemplary embodiment in the present disclosure does not have a separate via hole, and the area of the through-hole "H" of the support member may thus be significantly increased. As a result, the magnetic permeability of the coil electronic component may be improved, and the flow of the magnetic flux generated in the internal coil may be smoothed.

The maximum line width "W1" of the via 1212 on the boundary surface of the through-hole is not particularly limited, and may be substantially the same as the average line width of the coil pattern. This means that excessive plating of the via is not generated, because when the line width of the coil pattern is narrow, the line width of the via may also be narrow so as to be similar to that of the coil pattern. The maximum line width W1 of the via may be 0.8 times or more to 1.2 times or less than the line width W2 of the coil pattern where it directly connects to the via. When the line width of the entire internal coil is uniformly maintained, the line width W2 of the coil pattern directly connected to the via may be substantially the same as the average line width of the coil pattern. Limiting the deviation between the maximum line width W1 and the line width of the coil pattern to about 20% may prevent deterioration of the characteristics of the coil electronic component caused by non-uniform growth of the coil pattern.

Referring to FIG. 2, the via may form a predetermined angle "θ" from the direction of the coil pattern where it connects with the via. The predetermined angle may be less than 180°. That is, an angle may be formed to allow the via to be connected from the upper coil to the lower coil along the boundary surface of the through-hole of the support member. More preferably, the via may form a right angle from the coil pattern. In this case, the size of the via may be significantly decreased, and the packing factor of the magnetic material at the center of the coil core may be significantly increased, which can lead to advantageous electrical characteristics.

Meanwhile, the coil electronic component 500 according to the related art is different from the coil electronic component 100 according to the present disclosure in that the via 51 is not formed at an edge of the through-hole, but instead fills the via hole, and is thus formed along the via hole of the support member without changing direction from the coil pattern.

Referring to FIG. 2, opposite end portions of the support member supporting lead portions of the internal coil connected to the external electrodes may include slit portions "S". The slit portions may be selectively formed in order to prevent excessive plating of the lead portions. The cross-sectional shapes of the slit portions may be selected as desired or necessary. For example, there can be several slit portions each having a polygonal shape, an overall shape, a circular shape, or a combination thereof. The slit portions S may be formed before the internal coil is plated or after the internal coil is plated, and may be formed using a laser beam, a drill, or the like. When the slit portions S are formed after the internal coil is plated, shield processing may be performed using an insulating material on the upper and lower surfaces of the support member on which the slit portions are formed so that the upper and lower surfaces of the support member are not plated. The slit portions S may be filled with the magnetic material filling the through-hole of the support member.

The via 1212 may have a multilayer structure in which a plurality of conductive pattern layers are stacked, which will be described in detail with reference to the enlarged view of region "A" of FIG. 3.

Referring to the enlarged view of region A of FIG. 3, the via 1212 may include first to fifth conductive pattern layers. All of the first to fifth conductive pattern layers illustrated in FIG. 3 are not necessarily included in the vias, and additional conductive pattern layers may be included in the via 1212. Additional conductive pattern layers may be added in order to increase the aspect ratio of the coil, and anisotropic plating and/or isotropic plating may be appropriately combined with each other in consideration of process requirements.

The via 1212 may include a first conductive pattern layers 1212*a* separately in contact with the upper and lower surfaces of the support member and at the lowest layer of the plurality of conductive pattern layers. The first conductive pattern layer may be a copper (Cu) foil layer prepared in advance when the support member is prepared. The thickness of the first conductive pattern layer is not particularly limited, but may be about 20 μm when considering the thickness of a general copper foil layer of a copper clad laminate (CCL). The first conductive pattern layer may include a thin film layer formed by a separate sputtering process, in addition to the copper foil layer. Since various metals, in addition to metals that may be used in a plating process, such as molybdenum (Mo), nickel (Ni), and the like, may be selected, there may be an increased degree of freedom in selecting the material.

The first conductive pattern layers 1212*a* may be formed such that they are not in contact with the boundary surface of the through-hole. Where the first conductive pattern layer is prepared simultaneously with the support member and followed by formation of the through-hole, it is not possible to form the first conductive pattern layer on the boundary surface of the through-hole.

The second conductive pattern layer 1212*b* may be disposed on the first conductive pattern layers 1212*a*. The method of forming the second conductive pattern layer 1212*b* is not particularly limited, but may be, for example, chemical copper plating. The second conductive pattern layer 1212*b* may be formed to cover the entirety of an upper surface of the first conductive pattern layer 1212*a* on the upper surface of the support member, extend along the entirety of the thickness of the boundary surface of the through-hole, and cover a lower surface of the first conductive pattern layer 1212*a* on the lower surface of the support member. The second conductive pattern layer may serve as a base pattern layer when the via is formed to extend through the through-hole. The thickness of the second conductive pattern layer is not limited and does not need to be large since the second conductive pattern layer serves as the base pattern layer and thus does not need to contribute a substantial amount to the aspect ratio of the coil. For example, the thickness of the second conductive pattern layer may be 1 μm to 10 μm, but is not limited thereto.

The third conductive pattern layer 1212*c* may formed to cover the upper, lower, and inner surfaces of the second conductive pattern layer, using the second conductive pattern layer 1212*a* as the base pattern layer. The third conductive pattern layer 1212*c* may be formed by patterning a dry film and then filling a plating solution. The material of the third conductive pattern layer is not limited so long as it has excellent electrical conductivity, and may be, for example, copper (Cu), nickel (Ni), or the like. The third conductive pattern layer may be formed to extend through the through-hole, similar to the second conductive pattern layer.

Since the method of patterning the dry film and then filling the plating solution as described above is utilized when the via 1212 is formed, at least portions of edges of the via may be linearly formed. The dry film may serve as a guide for forming the via to control the shape of the via so that the via has the linear edges. As such, excessive plating of the via may be effectively prevented.

The fourth conductive pattern layer 1212*d* may have a relatively smaller thickness than that of the third conductive pattern layer 1212*c* and may be formed on the third conductive pattern layer. The fourth conductive pattern layer 1212*d* may be considered as an additional plating layer. In addition, an anisotropic plating layer substantially increasing the aspect ratio of the coil pattern may be formed as the fifth conductive pattern layer 1212*e* on the fourth conductive pattern layer 1212*d*.

Via 1212 does not require a via pad with a predetermined minimum size, and the line width of the via may be the same as or similar to that of the coil pattern. As a result, line width and thickness deviations of the coil pattern may be significantly decreased.

In addition to the via, coil patterns 123 forming the upper and lower coils may have a multilayer structure, similar to that of the via. Referring to an enlarged view of region "B" of FIG. 3, the coil patterns may include a plurality of conductive layers. FIG. 3 illustrates a coil on the upper surface of the support member, but is also applicable to a coil on the lower surface of the support member. A first conductive layer 123*a* of the coil pattern may be in direct contact with the upper surface of the support member, may be coplanar with the first conductive pattern layer 1212*a* of the via, and may include the same material as that of the first conductive pattern layer 1212*a* of the via. The first conductive layer 123*a* and the first conductive pattern layer 1212*a* may be formed by the same process. A second conductive layer 123*b* may be formed on the first conductive layer. The second conductive layer may be a thin film chemical copper plating layer. Since the first conductive layer and the second conductive layer are substantially formed by etching side surfaces by etching, or the like, the first conductive layer and the second conductive layer may consequently have the same line width. A third conductive layer 123*c* having the same line width as that of the second conductive layer may be formed on the second conductive layer. The third conductive layer is formed by patterning a dry film and filling a plating solution, and the shape of the third conductive layer may thus be comparatively easily controlled. A fourth conductive layer 123*d*, which is an additional plating layer, and a fifth conductive layer 123*e*, which is anisotropic plating layer, may be formed over the third conductive layer.

The method of manufacturing the coil electronic component according to the exemplary embodiment described with reference to FIGS. 1 through 3 may be appropriately selected. An exemplary processes of manufacturing the coil electronic component will be briefly described below.

Figure 4D:
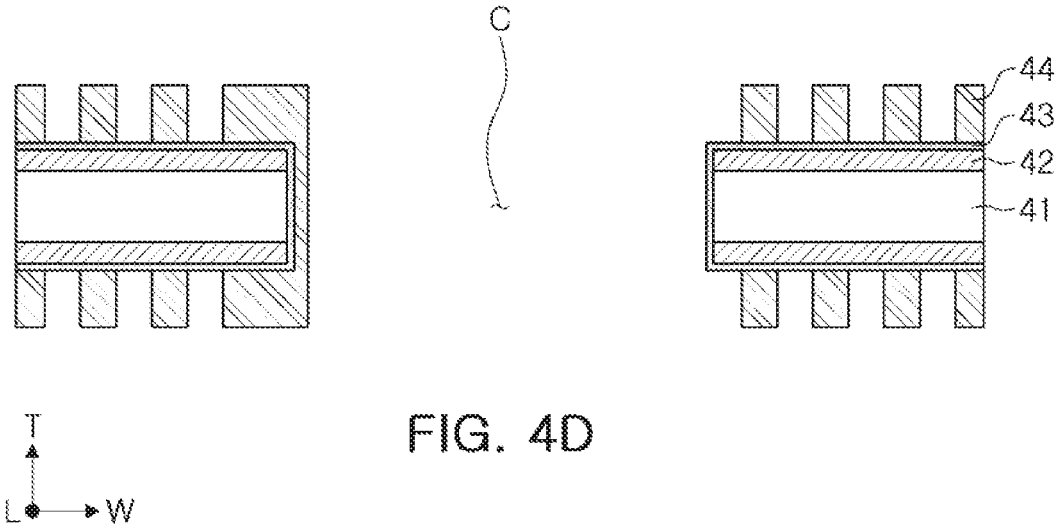

FIGS. 4A through 4H are views illustrating an exemplary processes of manufacturing the coil electronic component according to the exemplary embodiment. FIG. 4A illustrates a process of preparing a support member 41. In this case, copper foil layers 42 may be coated on the support member 41. Any known copper clad laminate (CCL), including copper foil layers formed on an insulating sheet, may be used for convenience. When any known CCL is used, a thin film type coil may be formed without changing the equipment for the process. The copper foil layers 42 may substantially constitute the lowermost layer of the via or coil pattern.

FIG. 4B illustrates a cavity process of forming a through-hole penetrating through upper and lower surfaces of the support member. The cavity process is conventionally performed as a post-process after an internal coil is completed. However, in the present disclosure, the via is formed using a boundary surface of the through-hole and the through-hole needs to be formed before the via is formed. Post-processing may be performed on the boundary surface of the through-hole. For example, post-processing for forming an unevenness structure on the boundary surface and post-processing for cleaning the boundary surface may be performed. The unevenness structure formed on the boundary surface may have any shape that may improve adhesion between the via and the support member when the plating layer for the via is formed on the boundary surface of the through-hole.

FIG. 4C illustrates a process of forming chemical copper plating layers 43 covering upper and lower surfaces of the respective upper and lower copper foil layers 42 on the support member and covering the boundary surface of the through-hole. The chemical copper plating layers 43 may serve as seed patterns for plating coil patterns. The chemical copper plating layers 43 may be formed by electroless plating or electroplating, but is not particularly limited thereto.

FIG. 4D illustrates a process of laminating dry films and then patterning the dry films to form desired patterns 44. The dry films may be patterned to open a portion of the boundary surface of the through-hole in order to form the via electrically connecting upper and lower coils to each other. Since the line width of the via may be controlled, the dry films may be patterned so that the line width of the via is substantially the same as that of the coil pattern.

Figure 4E:
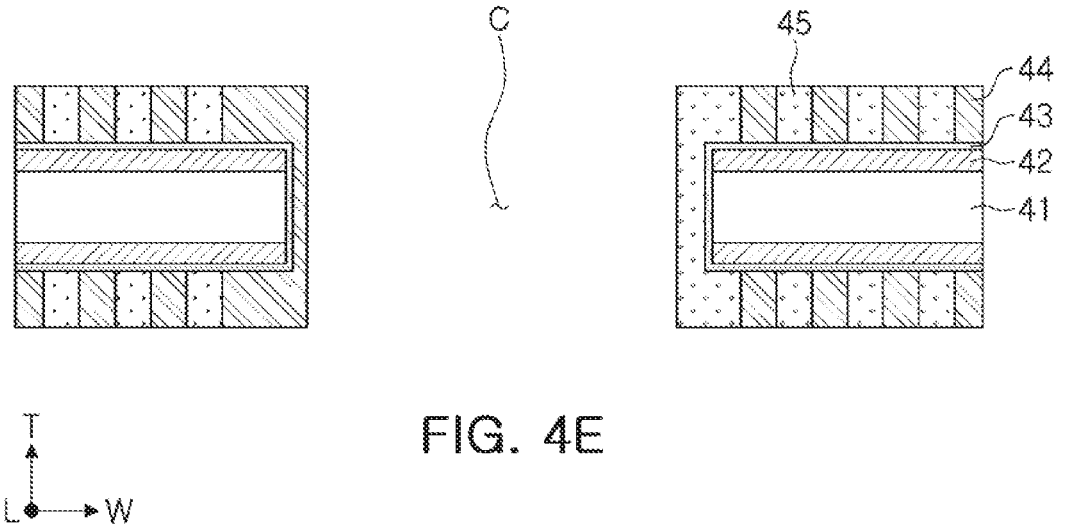

FIG. 4E illustrates a process of platting coil patterns 45 in openings of the patterned dry films. The coil patterns 45 may be formed to cover surfaces of the chemical copper plating layers 43 using the chemical copper plating layers 43 as the seed patterns. The thickness of the coil pattern may be selected depending on the thickness of the laminated dry film, and may thus be appropriately selected as needed or desired.

Figure 4F:
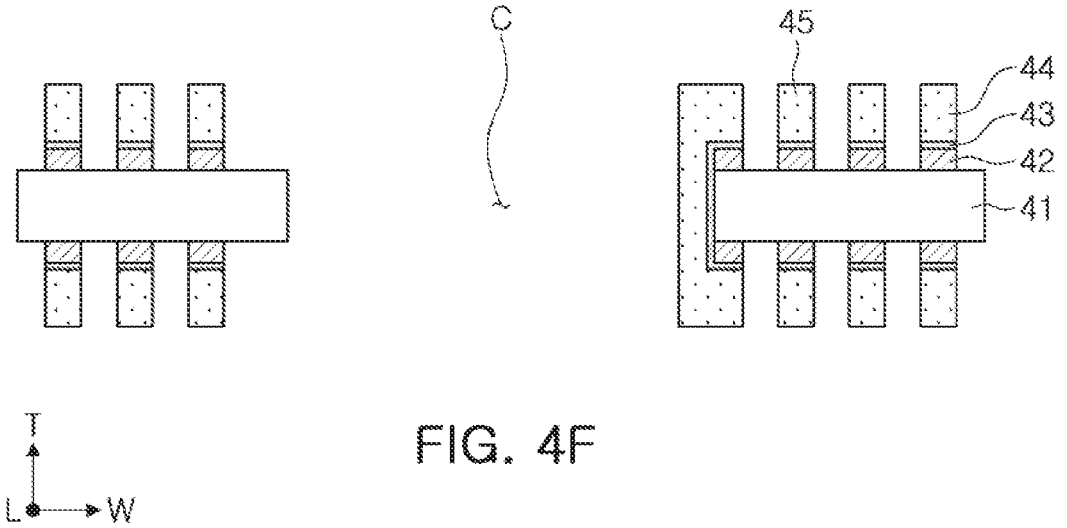

FIG. 4F illustrates a process of removing the dry films. The method of removing the dry film is not limited, but may be chemical etching or mechanical delamination.

Figure 4G:
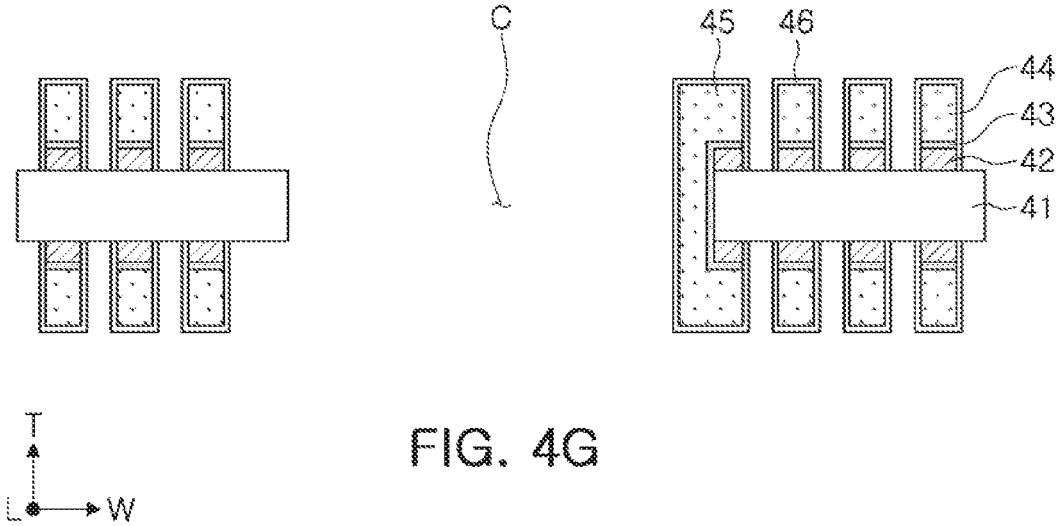
Figure 4H:
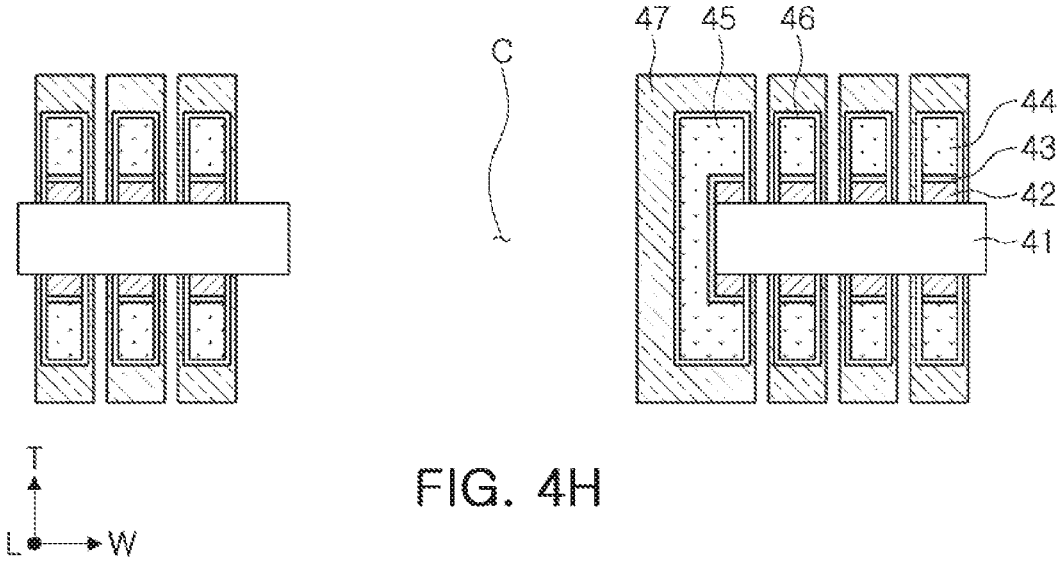

FIG. 4G illustrates a process of forming additional plating layers 46 surrounding multilayer structures of the remaining copper foil layers, the chemical copper plating layers, and the coil patterns. FIG. 4H illustrates a process of implementing a substantially high aspect ratio for the coil patterns by performing anisotropic plating on the additional plating layers to form anisotropic plating layers 47.

Although not illustrated in detail, subsequent processes may include a process of filling a magnetic material, a blading process of exposing lead portions of the coil, a plating process of forming external electrodes, and the like.

Figure 6:
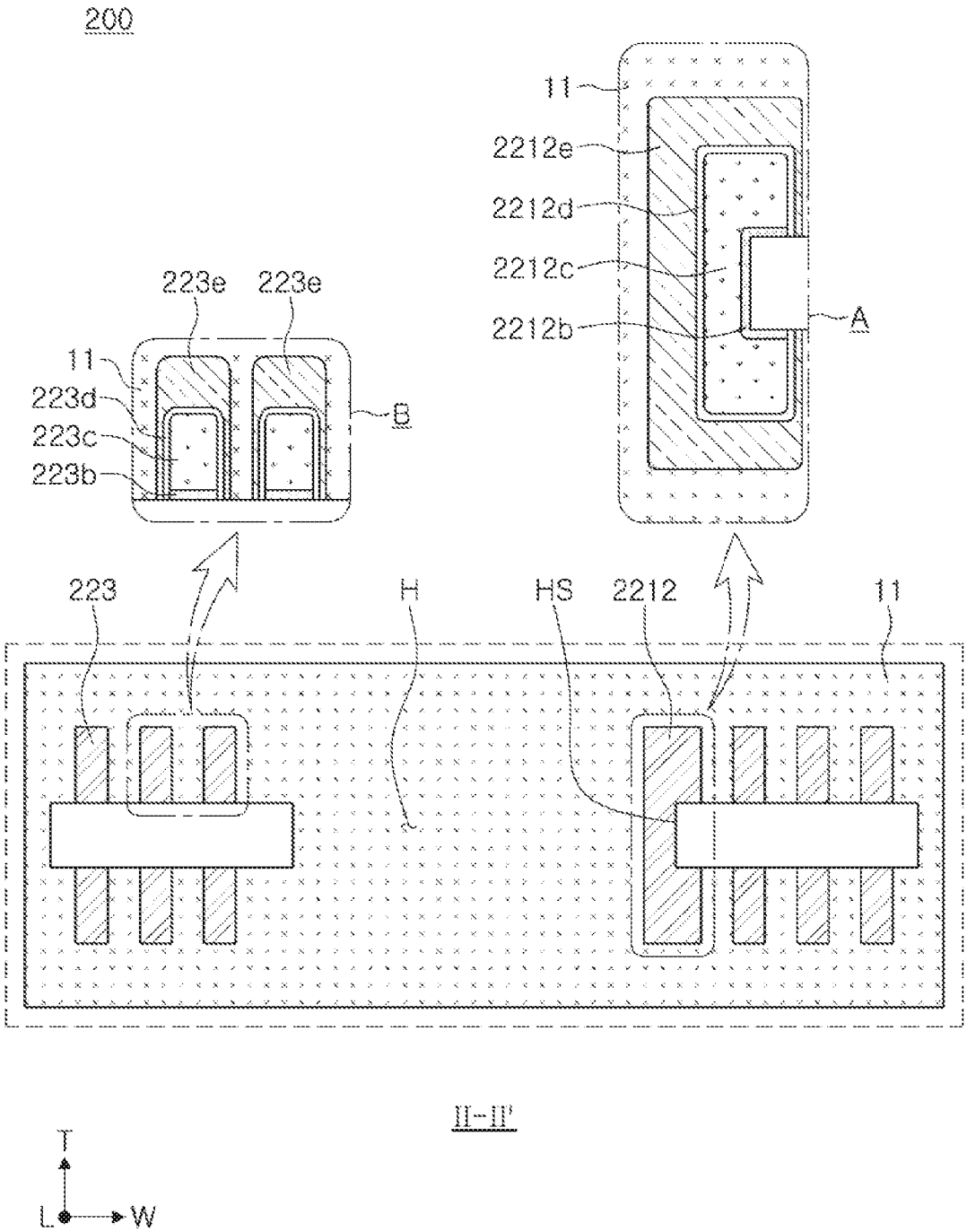
FIG. 6 is a cross-sectional view illustrating a coil electronic component according to another exemplary embodiment in the present disclosure.
Figure 7A:
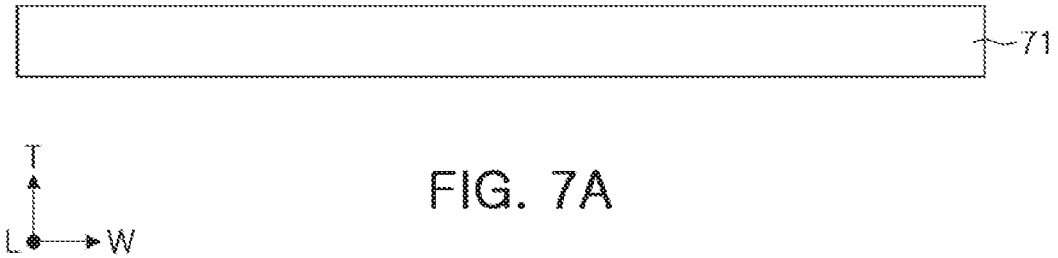
FIGS. 7A through 7G are views illustrating an exemplary processes of manufacturing the coil electronic component of FIG. 6.
Figure 7B:
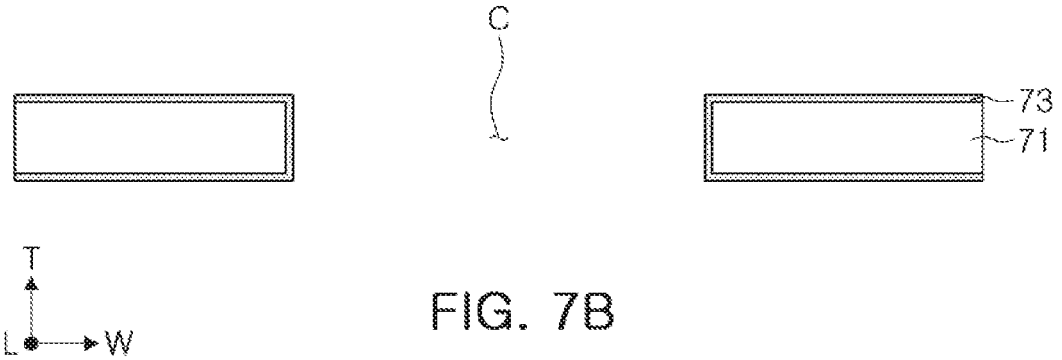
Figure 7C:
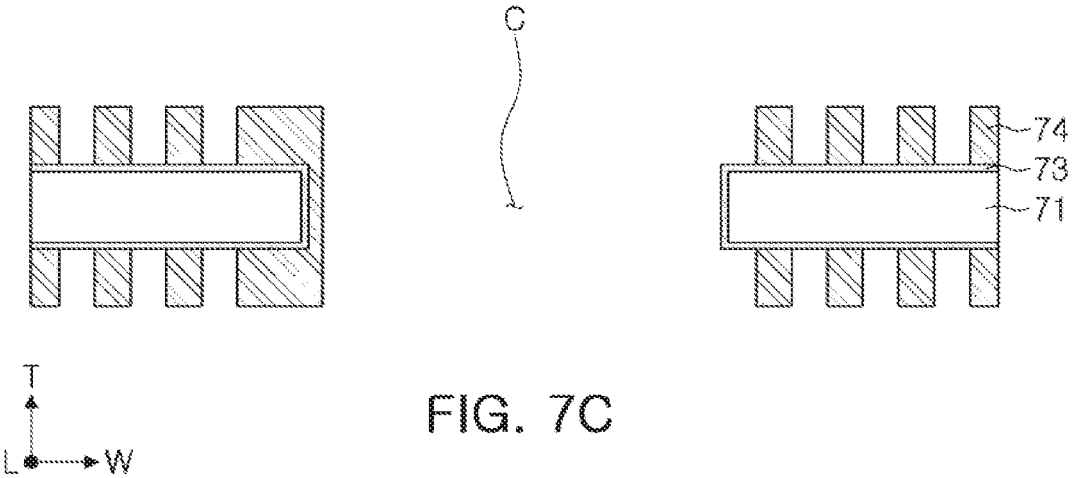
Figure 7D:
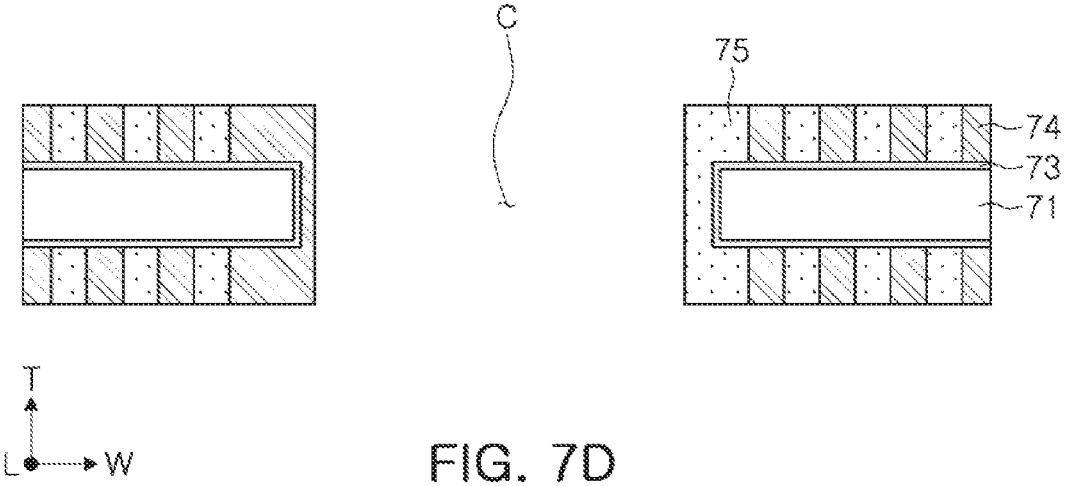
Figure 7E:
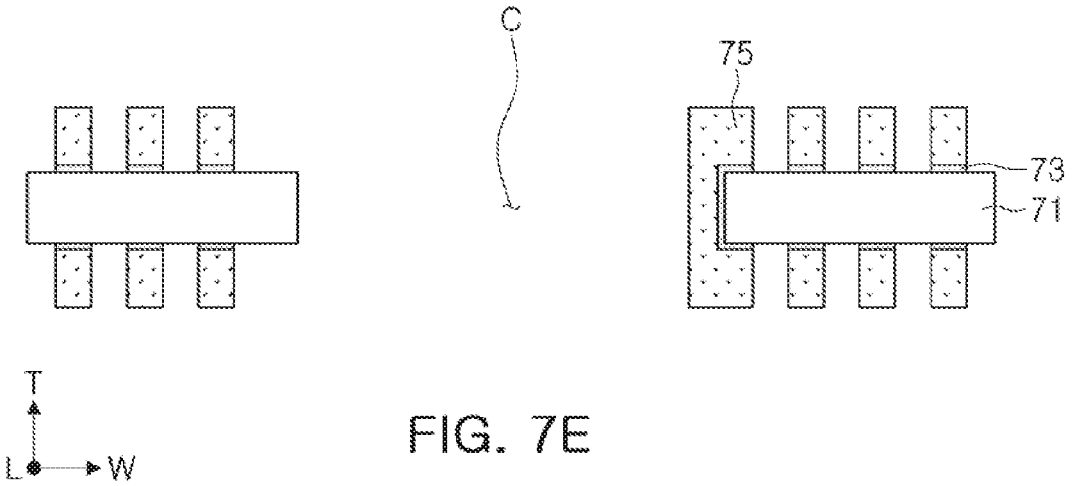
Figure 7F:
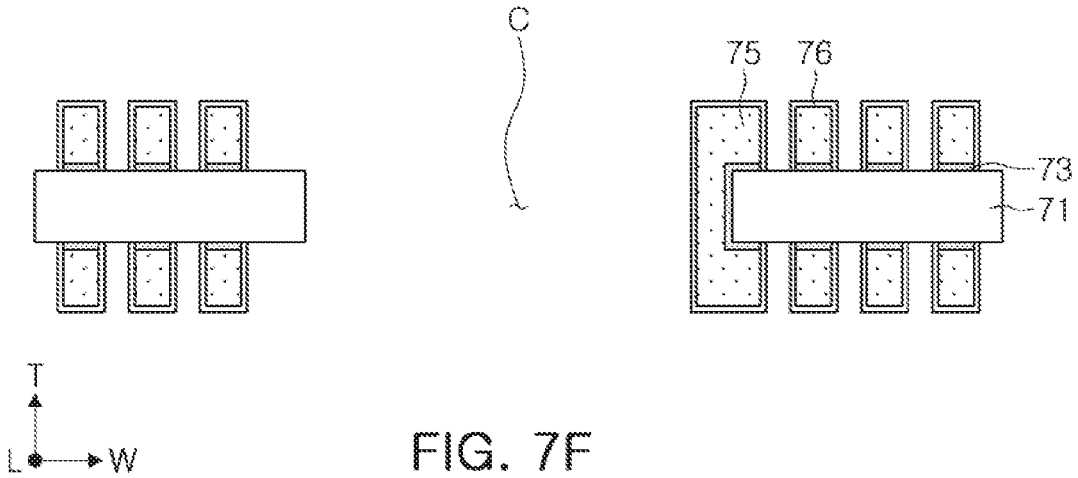
Figure 7G:
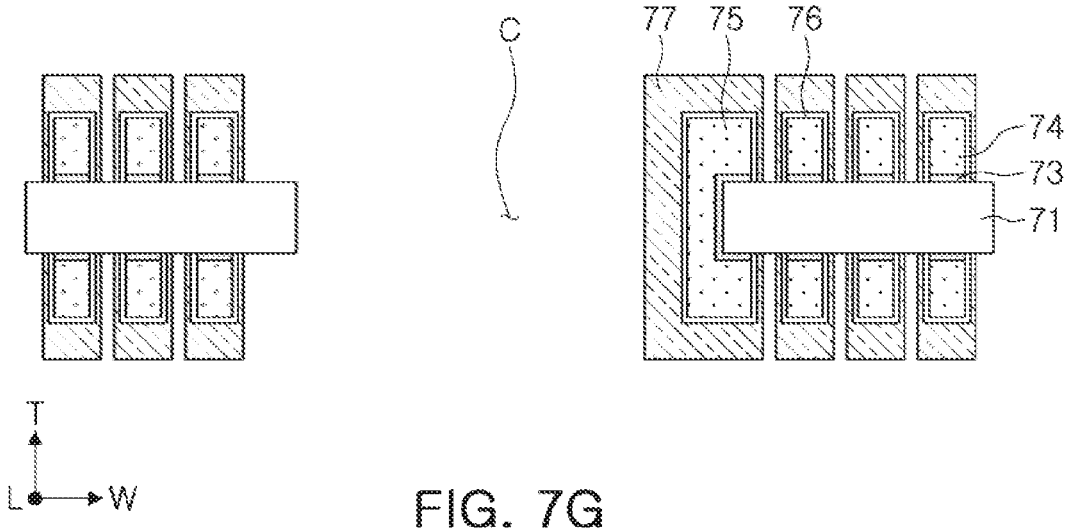

FIG. 6 is a cross-sectional view illustrating a coil electronic component 200 according to another exemplary embodiment in the present disclosure. The coil electronic component 200 includes some components that are substantially the same as those of the coil electronic component 100 according to the exemplary embodiment described above. For convenience of explanation, an overlapping description is omitted, and the same components are denoted by the same reference numerals. However, in order to distinguish the exemplary embodiments from each other, some reference numerals beginning with "1" are changed to begin with "2".

Referring to FIG. 6, a via 2212 of the coil electronic component 200 according to another exemplary embodiment may have a multilayer structure. The via 2212 is different from the via 1212 of the coil electronic component according to the exemplary embodiment in that it does not include the first conductive pattern layers 1212*a*. A second conductive pattern layer 2212*b* covering the upper and lower surfaces of the support member and the boundary surface of the through-hole may constitute the lowermost layer of the plurality of conductive pattern layers of the via 2212. This may be advantageous when using a thin film support member instead of any known CCL when the coil electronic component is implemented to be a low-profile product. Generally, when using any known CCL, a separate process of forming the first conductive pattern layer does not need to be performed, which is convenient, but the thickness of CCL may be approximately 60 μm, which may not satisfy the demand for a low profile. For a support member having a thickness significantly smaller than that of any known CCL is used, the second conductive pattern layer 2212*b* may be directly formed on the support member such that the size of the coil electronic component in the thickness direction may be decreased, and a relatively high aspect ratio of the coil pattern may be implemented. Third through fifth conductive patterns layers 2212*c*, 2212*d*, and 2212*e* may be disposed over the second conductive pattern layer, similar to third through fifth conductive pattern layers 1212*c*, 1212*d*, and 1212*e* described above.

A coil pattern 223 of the coil electronic component 200 according to another exemplary embodiment may have a multilayer structure, and may be different from the coil pattern of the coil electronic component 100 in that the first conductive layer is omitted. The structure of the coil pattern 223 may follow the trend toward a low profile and high aspect ratio of the coil electronic component. The lowermost layer of the coil pattern 223 may be a second conductive layer 223*b*, and third through fifth conductive layers 223*c*, 223*d*, and 223*e* may be disposed on the second conductive layer, similar to third through fifth conductive layers 123*c*, 123*d*, and 123*e* described above.

FIGS. 7A through 7G are views illustrating an exemplary processes of manufacturing the coil electronic component 200 according to another exemplary embodiment. The processes illustrated in FIGS. 7A through 7G are substantially the same as the processes of manufacturing the coil electronic component 100 according to the exemplary embodiment described with reference to FIGS. 4A through 4H, except that they further include a process of removing a first copper foil layer. Accordingly, an overlapping description is thus omitted. The components overlapping those described in the processes of manufacturing the coil electronic component 100 according to the exemplary embodiment described with reference to FIGS. 4A through 4H are denoted by the same reference numerals, but in order to distinguish the exemplary embodiments, some reference numerals beginning with a "4" are changed to begin with a "7".

As set forth above, according to the exemplary embodiments in the present disclosure, the coil electronic component of which electrical characteristics may be improved by decreasing non-uniformity of the coil patterns and a magnetic permeability may be increased by significantly increasing a core area may be provided.

While exemplary embodiments have been shown and described above, it will be apparent to those skilled in the art that modifications and variations could be made without departing from the scope of the present invention as defined by the appended claims.

What is claimed is:

1. A coil electronic component, comprising:

a body having disposed therein a support member with a through-hole, upper and lower coils on the support member, and a via connecting the upper and lower coils to each other; and external electrodes on external surfaces of the body, wherein the via is on at least a portion of a boundary surface of the through-hole, the via has a multilayer structure with a plurality of stacked conductive pattern layers including at least one conductive pattern layer that is free of contact with the support member and body, and two or more conductive pattern layers of the plurality of stacked conductive pattern layers extend through the through-hole and have thicknesses different from each other.

2. The coil electronic component of claim 1, wherein at least one conductive pattern layer of the plurality of conductive pattern layers extends along the portion of the boundary surface of the through-hole, and continuously extends to upper and lower surfaces of the support member.

3. The coil electronic component of claim 2, wherein the conductive pattern layer extending along the portion of the boundary surface of the through-hole and the upper and lower surfaces of the support member is a lowest layer among the plurality of conductive pattern layers.

4. The coil electronic component of claim 1, wherein a conductive pattern layer, of the plurality of conductive pattern layers, in contact with either an upper or lower surface of the support member layers includes Mo or Cu.

5. The coil electronic component of claim 1, wherein an outermost conductive pattern layer of the plurality of conductive pattern layers extends through the through-hole.

6. The coil electronic component of claim 1, wherein lead patterns of the upper and lower coils on the support member further include slit portions penetrating therethrough.

7. The coil electronic component of claim 6, wherein the slit portions are located adjacent to the external electrodes.

8. The coil electronic component of claim 6, wherein the slit portions are filled with a magnetic material.

9. The coil electronic component of claim 1, wherein the through-hole is filled with a magnetic material.

10. The coil electronic component of claim 1, wherein the via is formed on a first portion of the boundary surface of the through-hole, and a second portion of the boundary surface of the through-hole, other than the first portion, is in contact with an insulating layer or a magnetic material.

11. The coil electronic component of claim 1, wherein the upper and lower coils each include a plurality of coil turns other than the via, and each of the plurality of coil turns includes a plurality of conductive layers.

12. The coil electronic component of claim 1, wherein a line width of a first conductive layer, of the plurality of conductive layers, in contact with either an upper or lower surface of the support member is the same as that of a second conductive layer in contact with an upper surface of the first conductive layer.

13. The coil electronic component of claim 1, wherein a maximum line width of the via is 0.8 times to 1.2 times the line width of a coil pattern of the upper or lower coils where it is physically connected to the via.

14. The coil electronic component of claim 1, wherein at least a portion of an edge of a cross section of the via viewed from a top of the body is a substantially straight line.

15. The coil electronic component of claim 1, wherein the via is at an angle less than 180° with respect to a direction of a coil turn of the upper or lower coil where the coil turn is physically connected to the via.

16. A coil electronic component, comprising:

a support member including a through-hole;

an upper coil on an upper surface of the support member, including one or more upper coil turns;

a lower coil on a lower surface of the support member opposing the upper surface, including one or more lower coil turns;

a via connecting an innermost upper coil turn to an innermost lower coil turn, and extending from the upper surface of the support member, through the through-hole of the support member, to the lower surface of the support member; and a magnetic material in the through-hole of the support member and enclosing the upper and lower coils, wherein the via has a multilayer structure with a plurality of stacked conductive pattern layers including at least one conductive pattern layer that is free of contact with the support member and the magnetic material, and two or more conductive pattern layers of the plurality of stacked conductive pattern layers extend through the through-hole and have thicknesses different from each other.

17. The coil electronic component of claim 16, wherein a first width of a first portion of the via on the upper or lower surface of the support member is substantially the same as a second width of a second portion of the via extending on a boundary surface of the through-hole between the upper and lower surfaces of the support member.

18. A coil electronic component comprising:

a support member including a through-hole;

an upper coil on an upper surface of the support member, including one or more upper coil turns;

a lower coil on a lower surface of the support member opposing the upper surface, including one or more lower coil turns;

a via connecting an innermost upper coil turn to an innermost lower coil turn, and extending from the upper surface of the support member, through the through-hole of the support member, to the lower surface of the support member; and a magnetic material in the through-hole of the support member and enclosing the upper and lower coils, wherein the via comprises a plurality of stacked layers including:

an first upper layer on the upper surface of the support member and not extending through the through-hole;

an first lower layer on the lower surface of the support member and not extending through the through-hole; and a second layer on the upper and inner side surfaces of the first upper layer, on the lower and inner side surfaces of the first lower layer, and on a surface of the support member in the through-hole, and having a thickness of 1 μm to 10 μm.

19. The coil electronic component of claim 16, wherein the via comprises a plurality of stacked layers including:

an innermost layer on the upper surface of the support member, on the lower surface of the support member, and on a surface of the support member in the through-hole.

* * * * *